United States Patent [19]

Barbour

[11] Patent Number: 4,909,021

[45] Date of Patent: Mar. 20, 1990

[54] AUTOMATIC ENVELOPE OPENER

[76] Inventor: William P. Barbour, 8021 Nicky Ct., Laurel, Md. 20707

[21] Appl. No.: 278,495

[22] Filed: Dec. 1, 1988

[51] Int. Cl.[4] ..... B65B 43/26

[52] U.S. Cl. ..... 53/492; 53/381 R; 53/391; 493/245

[58] Field of Search ..... 493/245, 262, 437, 453; 53/492, 381 R, 384, 391, 390, 387

[56] References Cited

U.S. PATENT DOCUMENTS

| | | | |
|---|---|---|---|
| 3,116,718 | 1/1964 | Krupotich et al. | 53/381 R |
| 3,739,543 | 6/1973 | Harris | 53/492 |
| 3,884,010 | 5/1975 | Bardo et al. | 53/492 |
| 4,016,708 | 4/1977 | DeHart | 53/381 R |
| 4,373,848 | 2/1983 | Bishop | 53/381 R X |

*Primary Examiner*—James F. Coan
*Attorney, Agent, or Firm*—Nixon & Vanderhye

[57] ABSTRACT

A specially designed envelope and a companion envelope opening mechanism are disclosed which operate in combination such that the envelope is automatically opened in a single motion to expose the contents of the envelope for high speed machine or manual extraction. The envelope includes longitudinally disposed slits which run from a rear side fold line to points disposed along the length of the envelope along top and bottom fold lines. Disposed on the front wall of the envelope perpendicularly to the fold line slits are connecting members, a plurality of additional slits and a plurality of apertures. The plurality of apertures are disposed between the additional slits. The apertures provide openings into which extracting "fingers" of the automatic envelope opener enter the envelope during the envelope opening process to free a flap in the return address portion of the envelope to thereby expose the envelope contents.

21 Claims, 4 Drawing Sheets

FIG. 1
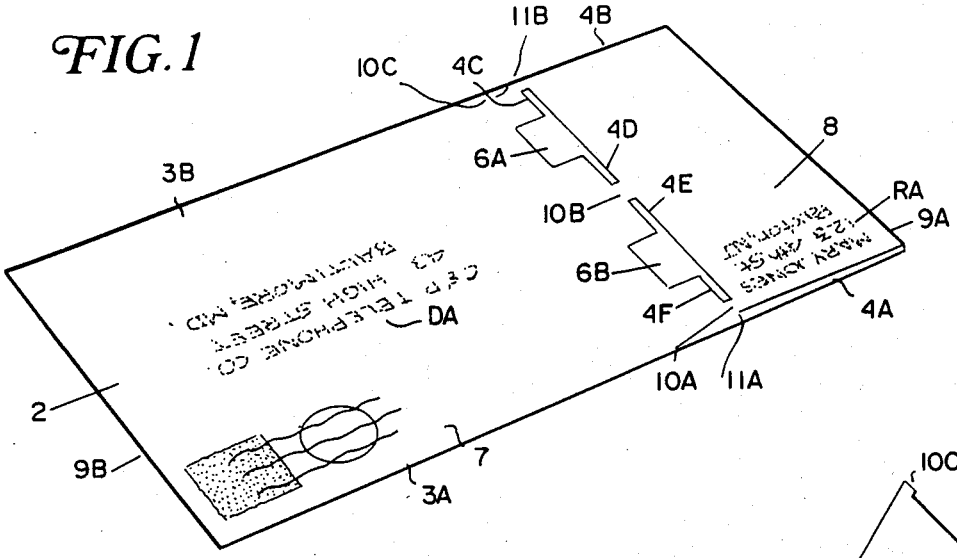
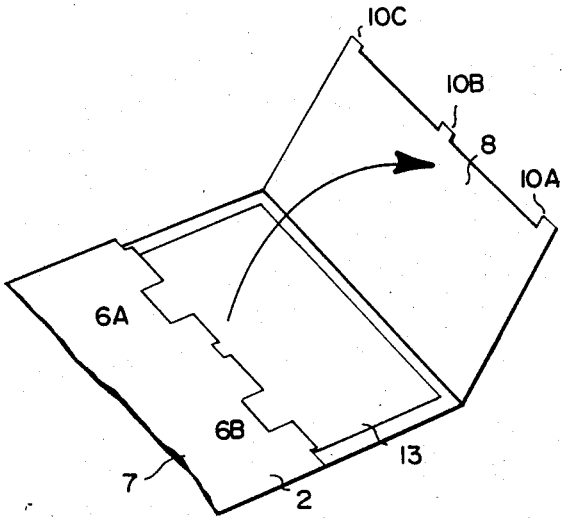
FIG. 2
FIG. 4
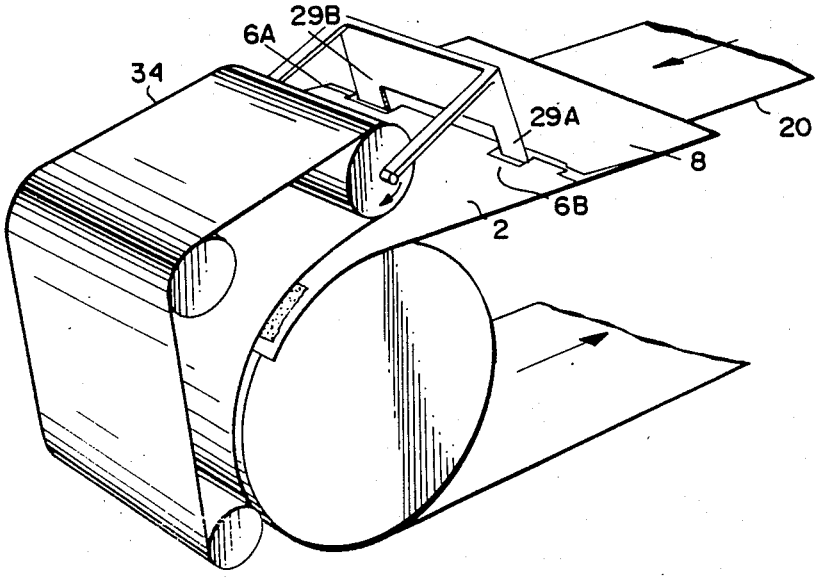

AUTOMATIC ENVELOPE OPENER

FIELD OF THE INVENTION

This invention generally relates to a method and apparatus for automatically opening envelopes such as those in which bills are typically mailed. More particularly, the invention relates to a high speed automatic envelope opener and a companion envelope designed to be opened thereby without being subjected to a slitting operation.

BACKGROUND AND SUMMARY OF THE INVENTION

Problems relating to efficiently processing large volumes of incoming mail are of significant concern to companies having a large customer base, particularly where customers are billed on a monthly basis. The end of the month volume of incoming mail in such companies is typically staggering. The manpower required to open such large volumes of mail and to sort and process the contents of such mail has contributed significantly to the companies' overhead which is typically passed on to the consumer via an increase in the cost of products and/or services.

Sophisticated equipment has heretofore been designed and utilized to reduce the time and the workforce required to process incoming mail. Such equipment has included automatic envelope openers that have been utilized in conjunction with automatic remittance processing equipment.

Small businesses which are unable to justify spending the funds necessary to procure a conventional automatic envelope opener have turned to utilizing envelopes which are designed for easy opening by mail room personnel. While such easy opening envelopes serve to make the manual envelope opening process somewhat easier, they still fall far short of providing a solution to efficiently handling and processing large volumes of incoming mail.

Automatic envelope opening equipment is commercially available in which envelopes are processed such that they are slit on one or more sides. Thereafter, such equipment either automatically removes the contents of the envelopes (and presents the contents to an operator) or delivers the slitted envelopes to an operator for content removal.

The present invention recognizes that such automatic envelope opening mechanisms have significant disadvantages. In this regard, the act of slitting or machining away the edge of an envelope has such serious drawbacks as increasing the probability that one or more edges of the documents in the envelope will be cut.

Under such circumstances, it is likely that the damaged document will be "rejected" by associated automatic remittance processing equipment which, for example, automatically reads preprinted information from the contents of the envelope, e.g., a bill or a check. Any increase in the number of items rejected by such remittance processing equipment adversely affects the overall mail processing speed and significantly detracts from the advantages of using automatic envelope opening equipment.

In order to reduce the risk of damaging internal documents, openers using slitting mechanisms have been designed to slit only an extremely limited portion of the envelope. By slitting such a limited portion of the envelope, such automatic openers at times do not operate to properly open the envelope with the expected high degree of success.

Other significant problems flow from the basic design of automatic openers which slit envelopes. In this regard, such openers present a hazard to mail room personnel due to the high speed knives or cutting blades that characterize such equipment. Additionally, in order to keep such blades razor sharp, a significant amount of maintenance and other servicing is required.

Additionally, such automatic envelope openers inevitably create a significant amount of paper dust by generating paper slivers during the envelope cutting process. Some of the dust and paper slivers is carried along with the envelope into other electronic devices that are utilized in automated remittance processing. Such remittance processing equipment typically includes optical sensing photocells for determining precisely where the envelope is in the processing path. Such photocells are prone to either failing or giving inaccurate readings due to the excessive dust which may result from the slitting of the envelopes.

Yet another conventional method of opening envelopes involves the use heat to cause the edge of the envelope to char to a point where the edge decays and falls away leaving the envelope open. The ash which is a by-product of such a process, as well as the ever present fire hazard, makes this method unsuitable for large scale utilization.

All of the above-described commercially available automatic envelope opening mechanisms have been designed to open a conventional envelope. By operating on such a conventional envelope, such envelope opening mechanisms have tended to utilize slitting mechanisms having the many disadvantages described above. Moreover, such automatic opening machinery, particularly the more sophisticated models, are so expensive that they are impractical for small to medium size businesses.

The present invention flowed from a recognition of the prior art problems described above and the discovery of a solution to such problems. The present invention overcomes the significant problems with the prior art automatic envelope opening mechanisms by incorporating a specially designed envelope and a companion envelope opening mechanism which operate in combination such that the envelope is automatically opened in a single motion to expose the contents of the envelope for high speed machine or manual extraction.

The envelope includes longitudinally disposed slits which run from a rear side fold line to points disposed along the length of the envelope along top and bottom fold lines. Disposed on the front wall of the envelope perpendicularly to the fold line slits are connecting members, a plurality of additional slits and a plurality of apertures. The plurality of apertures are disposed between the additional slits. The apertures provide openings into which extracting "fingers" of the automatic envelope opener enter the envelope during the envelope opening process to free a flap in the return address portion of the envelope to thereby expose the envelope contents.

The cooperating design of the envelope and the companion automatic opening mechanism, permits the automatic opening mechanism to be produced at a far less cost than prior art automatic opening mechanisms. Additionally, the present invention serves to insure repeatable envelope separation which promotes high speed automatic processing operations.

BRIEF DESCRIPTION OF THE DRAWINGS

These as well as other objects and advantages of the present invention will be better appreciated by reading the following detailed description of the presently preferred exemplary embodiments of the present invention taking in conjunction with the accompanying drawings of which:

FIG. 1 shows an envelope in accordance with an exemplary embodiment of the present invention.

FIG. 2 is a perspective view of the envelope shown in FIG. 1 after a flap has been freed and unfolded during automatic opening processing;

FIG. 4 is a perspective view of the automatic opener shown in FIG. 3 in the process of opening an envelope;

DETAILED DESCRIPTION OF THE DRAWINGS

Figure 3:
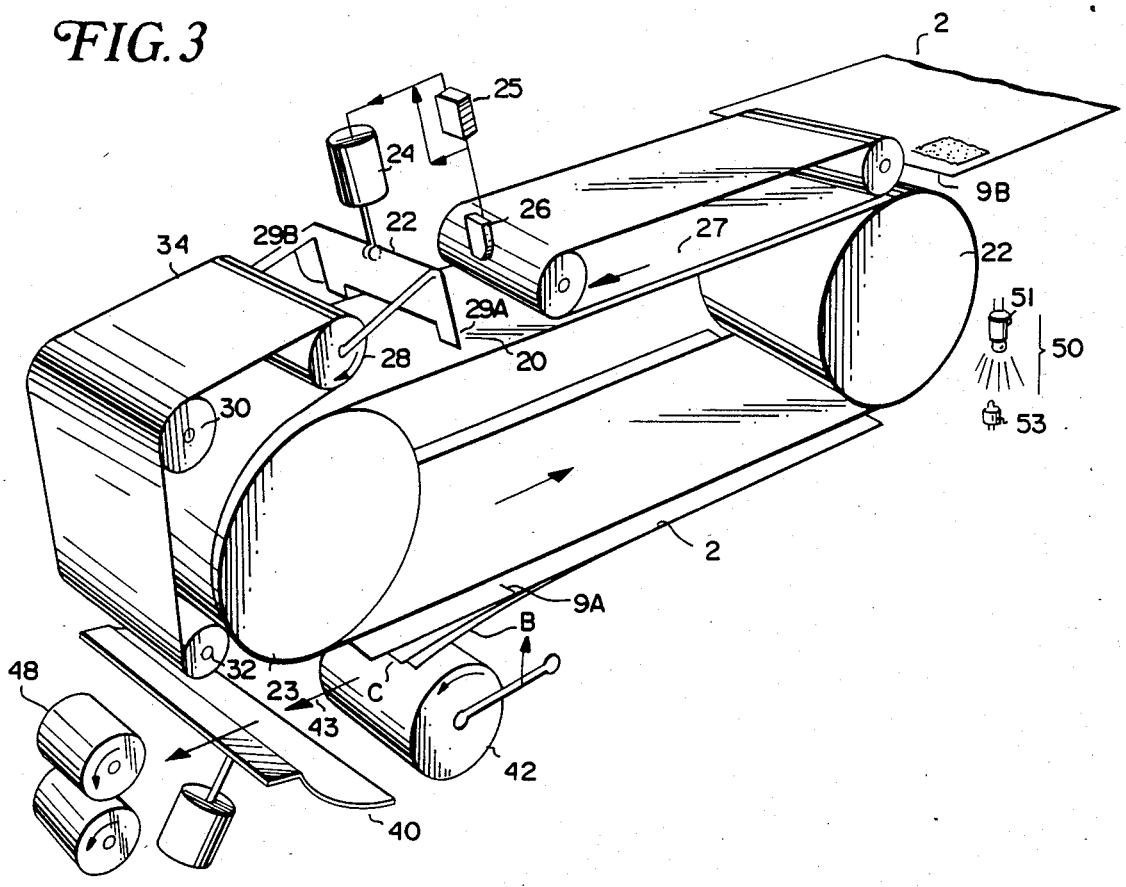
FIG. 3 is a perspective view of one exemplary embodiment of the automatic envelope opener in accordance with the present invention.

FIG. 1 shows an envelope 2 designed in accordance with an exemplary embodiment of the present invention. Envelope 2 is shown in its fully assembled form having a front wall 7, including a destination address section DA and return address section RA. The envelope 2 includes a top fold line 3A and a bottom fold line 3B. The envelope 2 also includes a rear side fold line 9A and a front side fold line 9B.

The envelope 2 is manufactured using a die cut (whose design will be apparent to those skilled in the art from FIG. 1) to provide the assembled envelope with the slits and apertures to be described below. In this regard, in the preferred embodiment, die cut slits 4A through 4F are disposed in the paper forming the envelope to define a flap 8 encompassing the return address portion RA. It should, of course, be recognized that the flap 8 and the slits 4A through 4F may alternatively be disposed to similarly encompass the stamp portion of the envelope shown in FIG. 1. It should also be recognized that although the die cut slits 4A through 4F in FIG. 1 are shown as having a cognizable width, preferably razor-like slits are cut into the paper at the time of manufacture.

In accordance with the preferred embodiment of the present invention, envelope 2 includes 2 longitudinally disposed slits 4A and 4B which run from rear side fold line 9A to points 11A and 11B, respectively. Slits 4A and 4B are disposed along the length of the envelope 2 along top and bottom fold lines 3A and 3B extending just past the return address section RA of the envelope as shown in FIG. 1.

Disposed perpendicularly to slits 4A and 4B and oriented colinearly with points 11A and 11B, are slits 4C, 4D, 4E and 4F. Two rectangular apertures 6A and 6B are defined between slits 4C and 4D and slits 4E and 4F, respectively. Although the apertures 6A and 6B are shown as being rectangular, it should be appreciated that they may alternatively be other shapes such as semicircular, elliptical etc. The apertures 6A and 6B provide openings into which the extractors "fingers" (described below in conjunction with FIGS. 3 through 6) enter the envelope during the envelope opening process. Although two apertures 6A and 6B are shown in FIG. 1, it should be appreciated that, depending upon the width of the envelope and other design considerations, more or less than two apertures may be provided.

The envelope includes a plurality of connecting members 10A, 10B and 10C. These connecting members 10A, 10B, and 10C are defined respectively by the gaps between point 11A and slit 4F, slits 4D and 4E and slit 4C and point 11B.

The distance between slits which define the length of the connecting members 10A, 10B, and 10C may vary but should be on the order of between a 1/32 of an inch and ½ of an inch. It should be appreciated that the optimal length for connecting members 10A, 10B, and 10C would be determined based on the nature of the paper stock used in manufacturing the envelope. In this regard, different paper stocks have different tear strengths and the length of the connecting members 10A, 10B and 10C would be selected to be long enough to provide the envelope with sufficient strength so as not to interfere with the typical mail handling processing, yet short enough to be conducive to a smooth controlled release by the equipment shown in FIGS. 3 through 7.

Similarly, the slits are designed so that they will not excessively weaken the envelope during travel through the mail system. Moreover, the slits are disposed so as not to interfere with mail handling equipment. The slits serve the function of strategically weakening the envelope for a planned rupture during processing by the automatic opening mechanism shown in FIGS. 3 through 6.

It is noted that while knife cut slits are the preferred implementation for weakened portions 4A through 4F, the present invention also contemplates that the strategic weakening of the envelope in these locations may be implemented by perforations and/or other envelope portion weakening techniques. It is noted, however, that by their very nature, perforations are meant to be snapped as a result of two counteracting forces and are not conducive to smooth release when treated otherwise. Thus, perforations do not allow for the highly controlled release achieved by the envelope shown in FIG. 1 with knife cuts but instead subject the envelope and contents to violent distortions prior to opening and thus do not guarantee repeatable separations. Instead, such perforations may, in fact, contribute to unpredictable tearing and partial opening which are unacceptable for high speed automated processing.

FIG. 2 shows the envelope 2 after its flap 8 has been freed and has started to unfold in the direction of the arrow. The flap 8 is preferably disposed in the return address portion RA of the envelope since bills having return address portions disposed to be oriented through a window in the envelope are oriented to expose a machine readable portion. In this fashion, a bill 13 will be oriented within the envelope such that a machine readable portion thereof is exposed and properly oriented.

The flap 8 is designed to open on the front wall 7 of the envelope opposite the glued envelope closing flaps disposed on the back wall of the envelope (not shown). The tabs 10A, 10B, and 10C shown in FIG. 2 correspond to the paper comprising the connecting members 10A, 10B and 10C shown in FIG. 1.

A first exemplary embodiment of the automatic opening mechanism of the present invention is shown in FIG. 3. As shown in FIG. 3, the automatic opening mechanism includes a belt 20, which preferably is of a width (e.g., one inch) substantially less than that of the envelope, which is driven by pulley 22 which in turn is driven by a motor (not shown). In addition to turning drive pulley 22 the associated motor is capable of starting and stopping the drive pulley 22 as required. The envelope 2 is placed on the belt either manually or is loaded in any number of automated fashions, and is held in place on the belt by a pressure belt 27 which securably positions the envelope on the belt. At least one other pressure belt (not shown) disposed on the bottom portion of the apparatus shown in FIG. 3 serves to secure the envelope 2 to belt 20 as the envelope travels along the bottom portion of the opener.

The envelope 2 is driven in the direction of the arrow shown in FIG. 3 until it reaches the vicinity of the extractor finger mechanism 22. After passing under extractor fingers 22, the leading edge 9B of envelope 2 is pinched by idler pressure roller 28 to tightly hold envelope 2 between belts 34 and 20 as envelope 2 is directed around roller 23. Belt 34 is also driven by drive pulley 22 which drives belt 34 around idler rollers 28, 30, and 32.

Extractor finger mechanism 22 is normally disposed in an uplifted position under a spring bias above belt 20. When the trailing edge of envelope 2 (i.e., edge 9A shown in FIG. 1) passes beneath photodetector 26, photodetector 26 generates a signal which energizes solenoid 24. Solenoid 24 drives extractor finger mechanism 22 downward towards belt 20 so that fingers 29A and 29B are disposed to enter the envelope's apertures 6A and 6B shown in FIG. 1. The opener may be designed such that photodetector 26 senses either the leading or trailing edge of envelope 2. If the trailing edge of envelope 2 is sensed, however, the automatic envelope opening mechanism may be utilized with envelopes of a wider variety of sizes than if the leading edge is sensed.

The photodetector 26 is disposed a distance away from extractor finger mechanism 22 such that if the extractor finger mechanism 22 is lowered as the rearward edge 9A of the envelope 2 is sensed, the fingers 29A and 29B of the mechanism 22 will meet the envelope 2 at a point just prior to entering envelope apertures 6A and 6B.

The energizing signal for solenoid 24 transmitted by photodetector 26 is also coupled to a timer 25. Timer 25 generates a timing signal which deenergizes solenoid 24, by way of example only, several milliseconds after it has urged extractor finger mechanism 22 downwardly. In this fashion, the extractor fingers 29A and 29B are controlled to enter the envelope apertures 6A and 6B and free the flap 8 shown in FIG. 2 from its parent material.

FIG. 4 shows the extractor fingers 29A and 29B entering the apertures 6A and 6B at a point where the envelope 2 is held tightly between belts 34 and 20. As can be seen in FIG. 3, the flap 8 is beginning to break free.

Figure 5:
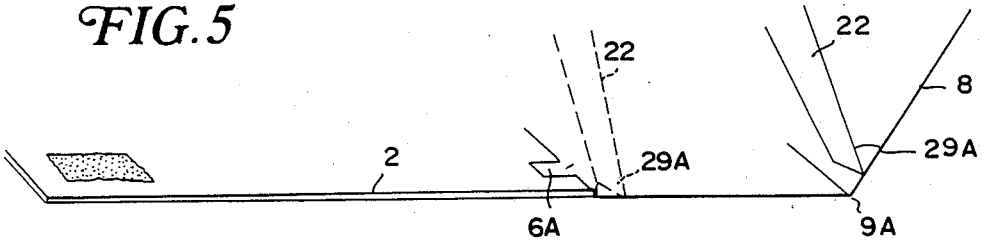
FIG. 5 is a perspective view of the extractor fingers of the automatic opener shown in FIG. 3 operating to rotate the freed flap.

FIG. 5 is a perspective view showing how the control of the elevation of finger mechanism 22 serves to rotate flap 8. Once the extractor fingers 29A and 29B have freed the flap 8, the mechanism 22 is raised. The fingers 29A and 29B continue to act on the envelope under the flap 8 in a manner to cause the flap 8 to rotate so that it trails behind the rear edge 9A of envelope 2.

The dashed line in FIG. 5 shows an extractor finger 29A at a point just after it initially entered aperture 6A. By lifting the extractor finger mechanism 22 after entry into apertures 6A and 6B, damage to the rear edge 9A of the envelope by contact with fingers 29A and 29B is avoided. Additionally, by raising the mechanism 22 as shown in FIG. 5, the fingers 29A and 29B serve to rotate flap 8 in a gentle "page turning" action. It is noted that fingers 29A and 29B are preferably configured to have a curved spoon shaped configuration so as to assist in the efficient entry into the envelope apertures 6A and 6B and rotation of flap 8.

Turning back to FIG. 3, as the envelope 2 continues to pass between belts 20 and 34, the leading edge of envelope 2 is met by a constraining mechanism 40 which is controlled to move towards roller 23 to guide the leading edge of envelope 2 between belt 20 and removal roller 42. After mechanism 40 has guided the leading edge of envelope 2 between belt 20 and removal roller 42, device 40 is automatically moved back to its original position away from roller 23 in the direction indicated by the arrow.

FIG. 3 shows the envelope 2 in a fixed position with the two documents that are contained therein exposed. The apparatus of FIG. 3 utilizes a photodetector (not shown) to stop the motion of belt 20 when the envelope 2 reaches the position shown for automatic removal of the envelope contents.

By way of example only, the documents in the envelope may be a check C, and a bill B. The removal roller 42 has a surface having a high coefficient of friction. Removal roller 42 is controlled to be moved towards and away from the documents B and C as required. In this regard, removal roller 42 may be, for example, controlled to move towards and away from documents B and C under the control of a solenoid, photodetector, and timing mechanism similar to those described above in conjunction with components 24, 25, and 26.

The roller 42, which is rotated under the control of a stepping motor (not shown) in the rotational direction of the arrow, initially makes contact with the bill B and urges it to the left in the direction indicated by the arrow 43. As soon as the bill B is extracted by the removal roller 42, the roller 42 is controlled to contact check C for extraction.

As the bill B is moved to the left, by removal roller 42, it is directed into a set of conventional de-doubling rollers 48. The de-doubling rollers are a conventional mechanism for insuring that a first document (e.g., bill B) which is provided by removal rollers 42 is acted upon and urged into appropriate remittance processing equipment before a second document, (e.g., check C) is urged into the remittance processing equipment. The de-doubling rollers 48 operate so that one roller rotates in the direction indicated by the arrow associated with removal roller 42 whereas the other roller moves at a somewhat slower speed in the opposite direction. In this fashion, a second document approaching the de-doubling rollers 48 would be kicked back by the reverse moving redoubling roller until the first document has completely passed through the de-doubling rollers. After the de-doubling rollers 48 have directed the bill B to the remittance processing equipment, the removal roller 42 is energized to make contact with the check C.

Once the check C has been removed from envelope 2, the envelope is scanned by a candler 50 or similar optical mechanism to insure that the envelope is empty. Thus, the envelope 2, after having its contents removed as described above, would be moved to the right pass candler station 50. As is conventional, candler station 50 includes a high intensity bulb 51 and a photodetector 53 which generates a signal if the envelope is in other than an empty condition. Thereafter, the envelope is disposed of. At the same time, another envelope would be in the process of being opened by the structure shown in FIG. 3.

It should be recognized that the configuration shown in FIG. 3, which allows for the automatic opening and removal of the contents of envelope 2, may be significantly simplified when it is desirable for a human operator to directly remove the envelope contents. In this regard, the structure shown in FIG. 3 may be modified to eliminate the removal roller 42, the constraining mechanism 40, and the de-doubling rollers 48. In this embodiment, as the major portion of the envelope is directed pass rollers 23 and 32, the flap 8 would be restrained by either a vacuum mechanism or a physical constraint such that the contents of the envelope, i.e., bill B and check C, may be readily extracted by an operator. For a small business operation, not processing large volumes of mail, this embodiment may be fully satisfactory.

Figure 6:
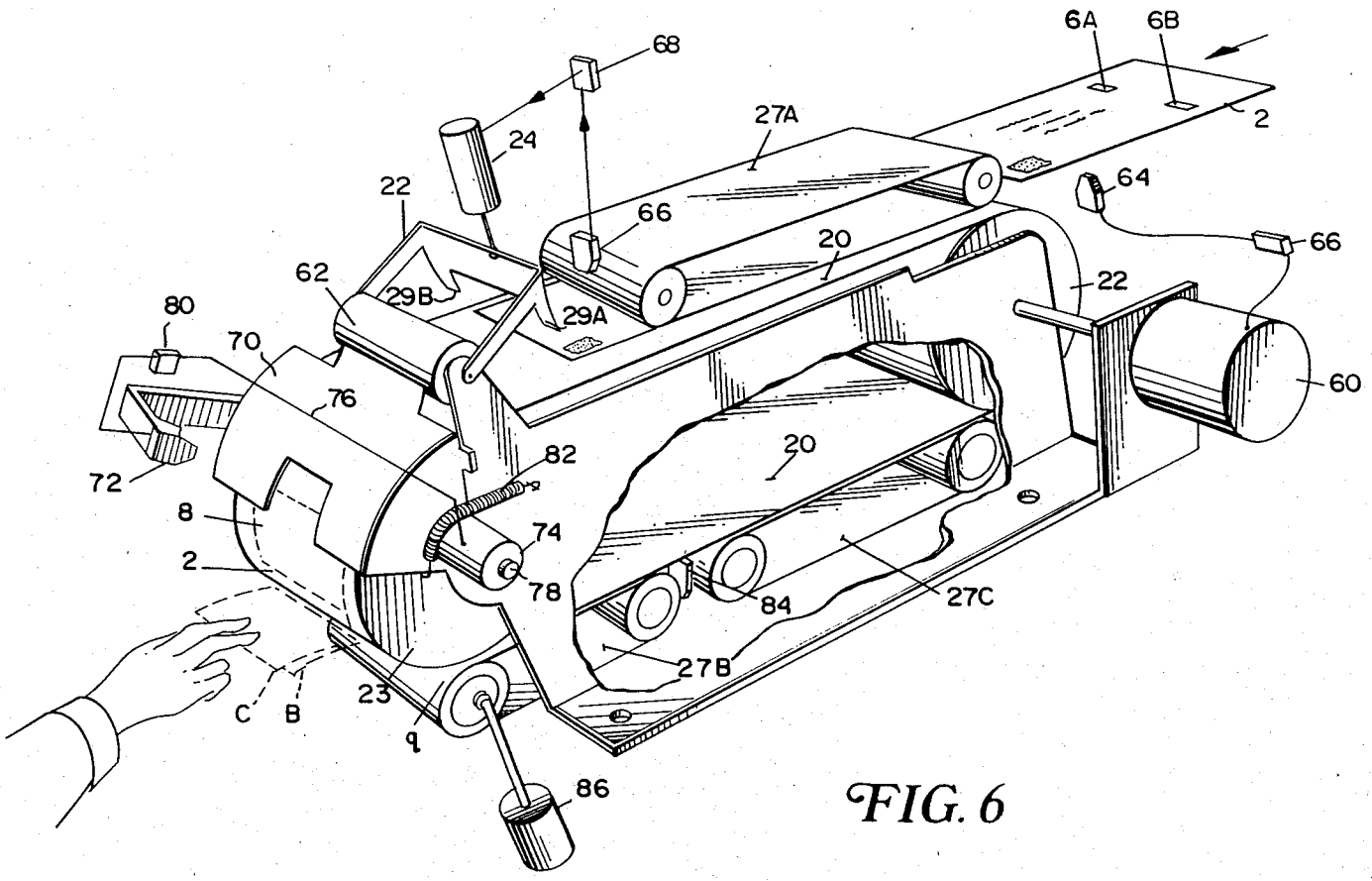
FIG. 6 is a perspective view of another exemplary embodiment of an automatic envelope opener in accordance with the present invention.

A further exemplary embodiment of an automatic envelope opener in accordance with the present invention is shown in FIG. 6. Components operating as described above in conjunction with FIG. 3 have been identified by corresponding reference numerals and will not be described in detail below.

The basic drive of the envelope opener shown in FIG. 6 consists of a belt 20 stretched over a drive roller 22 and an idler roller 23. The drive roller 22 is driven by a motor 60 capable of being started and stopped instantaneously (e.g., a stepping motor or a brake motor).

Once the envelope 2 has been introduced into the machine as shown in FIG. 6 its linear motion is effected by being pressed against the moving belt 20 by pressure belts 27A, 27B, and 27C and pressure roller 62. When photosensor 64 detects an incoming envelope 2, its starts motor 60 via motor driver 66 which, in turn, drives belt 20. Envelope 2 is then captured between belts 27A and 20 and moved leftward until it emerges and is detected by photosensor 66 which energizes solenoid 24 via time delay 68 to depress extractor finger mechanism 22 when envelope windows 6A and 6B are in a position to be entered.

FIG. 6 shows the extractor finger mechanism 22 in its raised position, i.e., photosensor 66 has detected emerged envelope 2 but time delay 68 has not yet signaled solenoid 24 to lower fingers 29A and 29B. Time delay 68 is set so that only after envelope 2 is well under the opening extractor fingers 29A and 29B will the solenoid 24 be actuated and the extractor fingers 29A and 29B lowered.

An envelope 2 is shown in dashed lines in position to have its' contents removed. The envelope flap 8 created as described above when the fingers 29A and 29B snapped the envelope 2 open is trapped under a control chamber 70 whose function will be described below.

The stamped end of the envelope 2 is snugly held between belts 20 and 27B at point q. With the envelope 2 thus held, the contents which comprises a bill B and a check C are left hanging in mid air, ready to be easily withdrawn by an operator as shown.

The envelope 2 was transported to the position shown by the tractive force produced by roller 62 pressing it against moving belt 20. As the envelope 2 rotated around the idler roller 23 its leading edge is detected by photosensor 72 which actuates via a signal on line 76 from timer 80 an electric clutch 74 which is fixedly attached to control chamber 70. The clutch 74 normally runs free on the idler shaft 78 but when energized, grips the shaft so that the control chamber 70 moves rotationally at the same speed as the envelope it encloses so that the leading envelope edge is controllably delivered into the juncture at point q formed by the confluences of moving belt 20 and idler belt 27B. Once the leading edge of the envelope 2 has been thus captured, timing circuit 80 controlling the electric clutch 74 shuts off and spring 82 pulls the control chamber 70 to the position shown in the drawing where it continues to constrain the envelope flap 8. When the leading edge of the envelope 2 is detected by photo cell 84, the motor 60 is shut off. When the motor 60 shuts off, a solenoid 86 which has been holding idler belt 27B in tight contact with transport belt 20 also is deenergized allowing pressure on the envelope 2 to be released so contents can be withdrawn effortlessly.

The machine remains at rest until the envelope 2 contents have been removed—at which point the process repeats itself. The new cycle is initiated when the contents leave the envelope 2 and a photosensor notes the increase in light being directed at it by a light source on the far side of the envelope at a conventional candler station (not shown). This is the commonly used method referred to as "candling" and not shown in this drawing in the interest of simplicity.

Figure 7:
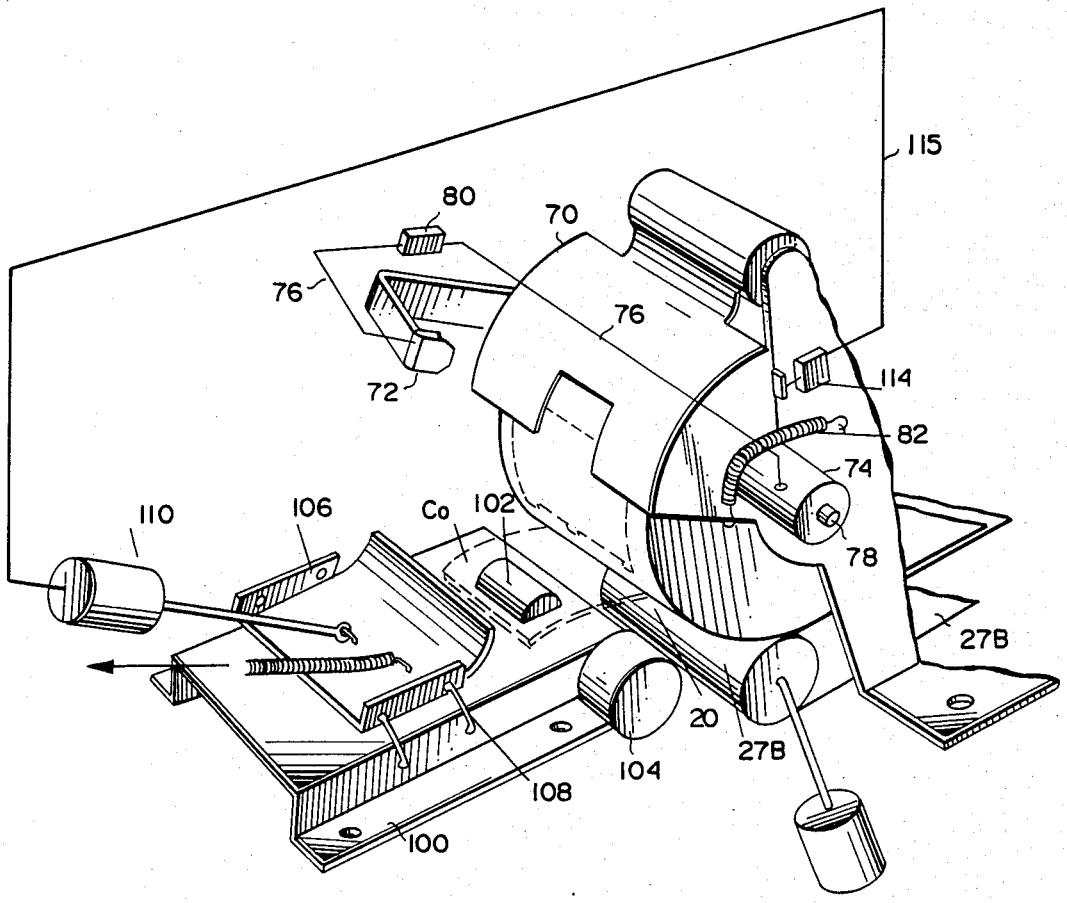
FIG. 7 is a perspective view of an automatic envelope contents extraction mechanism which may be used in conjunction with the opener shown in FIG. 6.

FIG. 7 is a modified version of the embodiment FIG. 6 which eliminates the need for an operator to pull the contents from each envelope 2. By adding the apparatus shown in FIG. 7 to that shown in FIG. 6, the resulting opener automatically removes the envelope contents and drops the contents onto a moving belt etc., for delivery to a collection pocket (not shown).

The chassis 100 is rigidly fixed to the main body of the machine such that the envelope 2 contents Co (shown in phantom outline) come to rest on a constantly turning, frictional roller 102. Roller 102 turns in a counter clockwise direction and is powered by a suitable motor 104. A pressure pad 106 of highly polished metal is suspended on a set of 4 legs 108 arranged as a parallelogram which is moved forward and downward under the influence of solenoid 110. Solenoid 110 drives the pressure pad 106 forward and downward until it comes to rest against the envelope contents Co. The contents are lightly resting on the constantly turning frictional roller 102 so that, when the pressure pad 106 comes in downward bearing contact with the contents Co, the contents Co are ejected from the envelope and onto a moving belt or other conveying means to a collection point.

Solenoid 110 and pressure pad 106 work in concert with the control chamber 70 in the following manner. Solenoid 110 is under control of switch 114. When control chamber 70 is in its raised position, as shown in the drawing, switch 114 is closed and solenoid 110 pushes the pressure plate 106 into its downward position causing envelope contents to eject.

When control chamber 70 starts to rotate downward under the control of components 72, 74, 76, and 80 as described above, performing its job of conducting the leading edge of the envelope to the junctures of belt 20 and belt 27B, switch 114 is released and power to solenoid 110 is removed via line 115 allowing spring 82 to retract pressure pad 106 to the position shown in the drawing.

With the pressure pad 106 thus held out of the way, the exposed envelope contents Co are free to drop downward against the constantly turning friction roller 102. As can be seen, when control chamber 70 has returned to its upwardmost position, as described above in conjunction with FIG. 6, switch 114 will be closed and pressure pad 106 forced forward and downward to effect the next ejection cycle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of automatically opening an envelope with an automatic opener having at least one extractor finger, said method comprising the steps of:

disposing an envelope on a conveyor means, moving said envelope relative to said at least one extractor finger;

automatically controlling said at least one extractor finger to enter said envelope;

breaking connecting members disposed on said envelope; and rotating a flap defined upon breaking said connecting members to thereby open the envelope.

2. A method according to claim 1, wherein automatically controlling step includes:

sensing a predetermined portion of said envelope with a photodetector means; and controlling said at least one protruding finger to enter an opening in said envelope in response to a signal from photdetector means.

3. A method according to claim 2, including the step of biasing said at least one protruding finger in a direction disposed away from said conveyor means, moving said at least one protruding finger towards said conveyor means under control of a solenoid; and deenergizing said solenoid after a predetermined period of time.

4. A method according to claim 1, further including the step of automatically removing the exposed contents of said envelope

5. A method according to claim 4, wherein removing step includes contacting said contents with a removal roller for directing said contents out of said envelope.

6. An automatic envelope opener comprising:

extractor finger means including at least one protruding finger for entering an opening in a wall of an envelope; and means for moving an envelope relative to said extractor finger means to permit said at least one protruding finger to enter said envelope to open the envelope, said extractor finger means further including means for detecting when said envelope is disposed in a predetermined relationship with respect to said extractor finger means and means for repositioning said at least one protruding finger relative to said envelope in response to detecting said predetermined relationship, whereby the contents of said envelope may be exposed.

7. An automatic envelope opener according to claim 6, wherein said means for detecting includes photodetector means for sensing a predetermined portion of said envelope; and wherein said means for repositioning includes control means responsive to said photodetector means for controlling said at least one protruding finger to enter an opening in said envelope and to open said envelope to expose the contents thereof.

8. An automatic envelope opener according to claim 7, wherein said at least one protruding finger is biased in a direction disposed away from said means for moving said envelope, and wherein said control means includes solenoid means for moving said at least one protruding finger towards said means for moving said envelope;

and timing means for deenergizing said solenoid means after a predetermined period of time.

9. An automatic envelope opener according to claim 6, wherein said means for moving includes a conveyor belt for moving an envelope towards said extractor finger means.

10. An automatic envelope opener according to claim 6, further including envelope content extracting means for automatically removing the exposed contents of said envelope.

11. An automatic envelope opener according to claim 10, wherein said envelope content extracting means includes removal roller means for contacting said contents and for directing said contents out of said envelope.

12. An automatic envelope opener according to claim 6, wherein said extractor finger means includes means for positioning said at least one protruding finger at a first position above said means for moving; and means responsive to said means for detecting for lowering said at least one protruding finger to contact and open the envelope.

13. An automatic envelope opener according to claim 12, wherein said extractor finger means includes means for automatically raising said at least one protruding finger after said envelope has been opened.

14. An automatic envelope opener according to claim 6, further including envelope content removal means for removing the contents of the opened envelope and constraining means for guiding said envelope to said envelope content removal means.

15. An automatic envelope opener according to claim 14, wherein said means for removing includes removal roller means for contacting the envelope and extracting the contents.

16. An automatic envelope opener according to claim 14, wherein said means for removing includes de-doubling roller means for directing the envelope contents in a desired direction.

17. An automatic enveloper opener according to claim 14, further including means, disposed downstream of said envelope content removal means, for monitoring the envelope to determine that its content have been removed.

18. An automatic envelope opener according to claim 6, wherein said means for moving includes conveyor belt means driven by a driver roller and an idler roller and pressure belt means for pressing the envelope against said conveyor belt means.

19. An automatic envelope opener according to claim 6, further including envelope content removal means for removing the envelope contents, said removal means including means for sensing when a predetermined portion of the envelope has reached a content removal station, and means for temporarily stopping said means for moving in response to reaching said content removal station.

20. An automatic envelope opener according to claim 19, wherein said removal means includes pressure pad means for contacting the envelope contents for extracting the contents from the envelope.

21. An automatic envelope opener according to claim 6, wherein said opening in the wall of an envelope comprises a razor-like slit in the envelope.

* * * * *